United States Patent [19]

Ballard

[11] Patent Number: 4,631,454

[45] Date of Patent: Dec. 23, 1986

[54] QUASI-RESONANT RANDOM ACCESS DEFLECTION SYSTEM FOR A CALLIGRAPHIC DISPLAY MONITOR

[76] Inventor: Paul T. Ballard, 2409 Westlawn Dr., Kettering, Ohio 45440

[21] Appl. No.: 715,519

[22] Filed: Mar. 25, 1985

[51] Int. Cl.[4] ..... H01J 29/70

[52] U.S. Cl. ..... 315/408; 315/365; 340/739

[58] Field of Search ..... 315/365, 399, 406, 407, 315/408; 340/731, 732, 736, 739

[56] References Cited

U.S. PATENT DOCUMENTS

| | | | |
|---|---|---|---|
| 3,681,646 | 8/1972 | Brehm | 340/736 |
| 3,934,173 | 1/1976 | Korver | 315/408 |
| 3,976,990 | 8/1976 | Haak | 340/724 |
| 4,491,835 | 1/1985 | Aron | 315/408 |
| 4,551,657 | 11/1985 | Miller et al. | 315/399 |

OTHER PUBLICATIONS

Motorola Application Note, "A Self-Regulating Horizontal Scan System", pp. 2–9.

Dendinger, "Simplified High-Efficiency Motor Drive Systems with New PWM Integrated Circuits", pp. 315–319.

*Primary Examiner*—Theodore M. Blum

*Assistant Examiner*—D. C. Cain

*Attorney, Agent, or Firm*—John R. Flanagan

[57] ABSTRACT

A quasi-resonant random access deflection system includes a biresonant, bidirectional deflection circuit connected to the deflection yoke of a display monitor picture tube and a control circuit connected to the deflection circuit and being operable to generate signals to actuate the deflection circuit so as to cause, via the magnetic fields of the deflection yoke, selected movement of the electron beam of the picture tube along a bidirectional path and stopping of the beam at any position along the bidirectional path.

26 Claims, 10 Drawing Figures

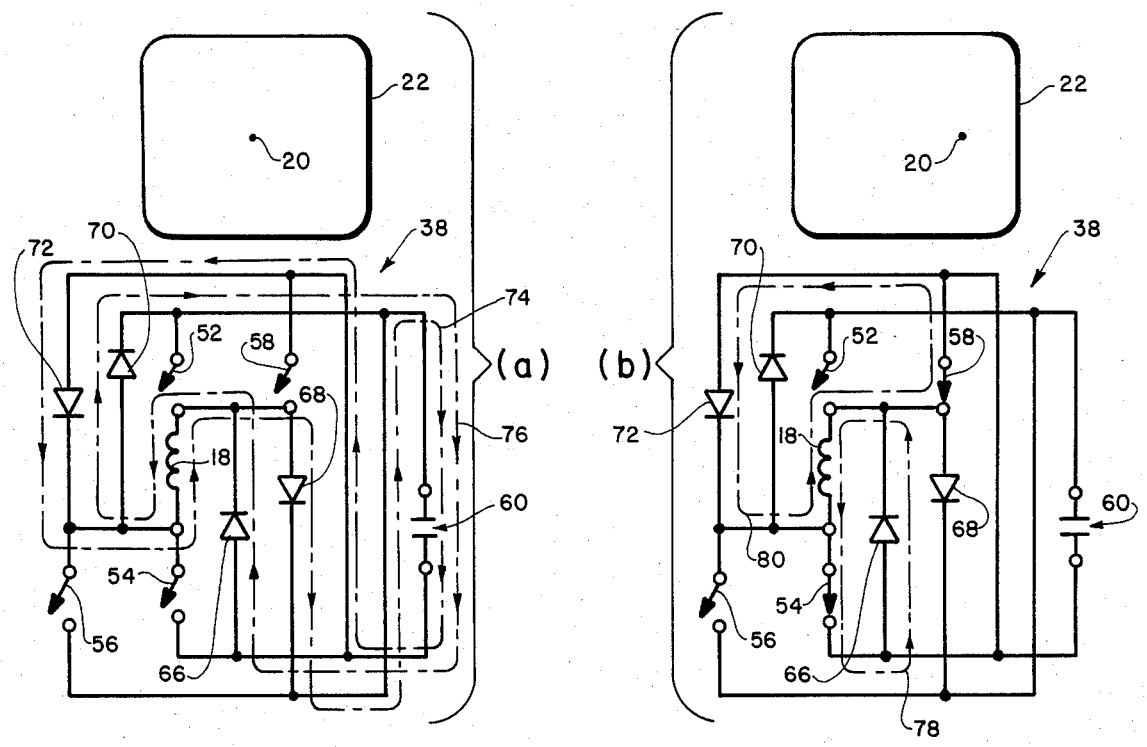
Fig. 6
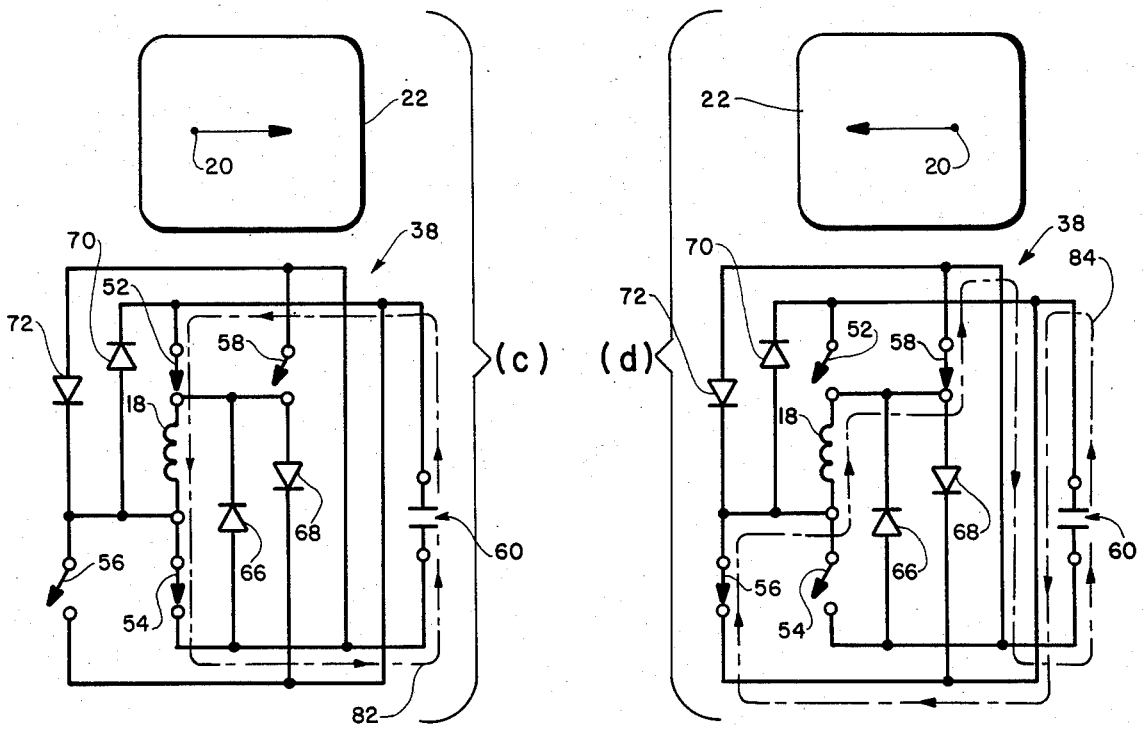

QUASI-RESONANT RANDOM ACCESS DEFLECTION SYSTEM FOR A CALLIGRAPHIC DISPLAY MONITOR

BACKGROUND OF THE INVENTION

1. Field of the Invention

The present invention relates generally to display of information on a video monitor and, more particularly, is concerned with a quasi-resonant random access deflection system to enable a high performance calligraphic, or random access-type, display monitor to operate at power levels heretofore typical only of a raster scan, or resonant-type deflection, display monitor.

2. Description of the Prior Art

Television receivers and other CRT type devices typically use a beam of fast-moving, magnetically deflected electrons to produce a video picture. Two sets of electromagnetic windings are commonly used to achieve deflection of the electron beam. These sets of windings are assembled into a deflection yoke to produce vertical and horizontal magnetic fields which fluctuate with respect to time in order to deflect the electron beam in the horizontal and vertical directions. The beam may be made to impact anywhere on the screen of the display monitor by passing the correct amount of current through the deflection yoke.

Two basic types of systems for controlling current flow in the deflection yoke are in use at the present. Of the two, the more widely-used one is the raster scan resonant deflection system; such as used in the control of the conventional television receiver. The other, less widely-used one, is the vector scan random deflection system; commonly used in display monitors for computer aided design (CAD) and simulation equipment.

In the raster scan system, a sawtooth waveform of current is passed through the horizontal deflection windings causing the spot to scan from left to right across the screen of the display monitor and then retrace to the left and, similarly, another sawtooth waveform of current is passed through the vertical deflection windings causing the beam to scan from top to bottom and then retrace to the top. The combined action of the vertical and horizontal magnetic fields on the electron beam produces a frame of light on the screen called a raster.

The raster scan deflection system is highly efficient in terms of energy use. Scanning and retrace of the beam is mainly produced through exchange and recovery of a given quantity of energy between the shaper and flyback (or retrace) capacitors of a circuit oscillating in concert with the deflection yoke at their combined resonant frequency. Except for small ohmic losses in the deflection yoke windings and losses within the resonant switch of the system, a resonant amplifier merely controls the transfer of energy between the yoke's magnetic field and the electric field within the pair of capacitors. Even though several millijoules of energy are exchanged up to 256,000 times per second in a modern high performance display monitor, power dissipation in the resonant amplifier is typically only a few watts. Similarly, the current draw on the power supply of the system is usually only several hundred milliamperes whereas the peak deflection yoke current may be 5 to 10 amperes.

Since information must be provided which relates to each picture element, or pixel, as the electron beam is scanned during the production of each frame, the raster scan deflection system is inefficient in terms of the inordinately large amount of computation and storage which is required.

In the vector scan system, a control signal, either analog or digital, corresponding to the coordinates or vectors of the desired location of the electron beam on the screen of the display monitor is supplied by the user to X and Y inputs of the deflection amplifier. Thus, the electron beam, rather than being moved through a scan and retrace pattern as in the raster scan system, is moved and positioned at random on the screen.

The vector scan system is highly efficient in that only a small quantity of information must be provided to support calligraphic applications. Only a comparatively short list of vectors need be stored in memory to direct the electron beam to the correct screen positions.

On the other hand, random access deflection is conventionally accomplished with a linear-mode amplifier. The linear amplifier is used to produce the desired waveform to deflect the electron beam. In a high performance random access display monitor, peak deflection yoke currents and deflection voltages can easily reach 20 amperes and 75 volts respectively. A linear-mode random access deflection amplifier may therefore have to dissipate several orders of magnitude greater power than a resonant type amplifier.

Heretofore, the conventionally accepted practice has been to choose between the use of one or the other of the two types of electron beam deflection systems; the raster scan resonant system or the vector scan random system. Along with the advantages associated with the selected system, the user regrettably also had to accept its drawbacks. It was thought that no merging of the two systems was possible. No matter how desirable the advantages of the raster scan resonant deflection system are, informed opinion in the field has heretofore considered the system unadaptable to random access deflection.

A few words of explanation might help to understand this conventional thinking. The resonant deflection amplifier is not really an amplifier at all. It amplifies nothing. Rather, it controls the transfer of energy between the pair of capacitors (shaper and flyback) and the yoke windings, synchronously with the video signal modulating the electron beam. Thus, the conventional resonant deflection amplifier has heretofore not been considered suitable for random access deflection. As a random access deflection amplifier, it has two fundamental shortcomings. First, there is no mechanism by which the electron beam can be "parked". That is to say, the resonant deflection amplifier cannot position the electron beam; it can only scan the beam across the face of the display monitor screen. Second, right-to-left deflection in a resonant deflection amplifier is intrinsically different from left-to-right deflection.

Notwithstanding the weight of conventional authority, which maintains that these two types of deflection systems are not compatiable and counsels against any expectation of success in achieving a merger of their more desirable features into a hybrid-type deflection system suitable for calligraphic applications, it is perceived that a need still exists for a fresh design approach to accomplish just that, one having the objective of bridging the dichotomy between these two deflection systems.

SUMMARY OF THE INVENTION

The present invention provides a quasi-resonant random access deflection system which ignores conventional wisdom and satisfies the aforementioned needs. Underlying the present invention is the discovery that by making a few modifications to the conventional raster scan resonant deflection amplifier, a truly randon access deflection can be achieved. Prior to the present invention, the designer of an information display system had to compromise on the display design in favor of overall system requirements due to the very high power dissipation typical of high performance calligraphic display monitors. This was particularly true in applications where the power consumption and dissipation of several kilowatts would be totally unacceptable. The present invention will allow the system designer to select a calligraphic display monitor wherever it is appropriate to the system needs, without power or performance penalties.

Accordingly, the present invention is directed to a quasi-resonant random access deflection system for a video display apparatus, such as a calligraphic monitor, having means generating an electron beam and a deflection yoke operable for magnetically deflecting the beam, wherein the system comprises: (a) a quasi-resonant deflection circuit connected to the deflection yoke and being actuatable to cause selected movement of the beam along a bidirectional path and stopping of the beam at any position along the bidirectional path; and (b) a control circuit connected to the quasi-resonant deflection circuit and being operable to actuate the quasi-resonant deflection circuit.

More particularly, the quasi-resonant deflection circuit includes a plurality of switches being actuatable to predetermined combinations of states to cause the selected movement and stopping of the beam. The control circuit is operable to actuate these switches to the predetermined combinations of states. Specifically, the resonant deflection circuit (1) causes the beam to assume an undeflected position when the switches are actuated to a first combination of states, (2) causes holding of the beam at a substantially stationary position along the bidirectional path when the switches are actuated to a second combination of states, (3) causes deflection of the beam in a first direction along the bidirectional path when the switches are actuated to a third combination of states, and (4) causes deflection of the beam in a second opposite direction along the bidirectional path when the switches are actuated to a fourth combination of states.

There and other advantages and attainments of the present invention will become apparent to those skilled in the art upon a reading of the following detailed description when taken in conjuction with the drawings wherein there is shown and described an illustrative embodiment of the invention.

BRIEF DESCRIPTION OF THE DRAWINGS

In the course of the following detailed description, reference will be made to the attached drawings in which:

FIG. 6 is a series of views of the screen of the display monitor of FIG. 1 and of the bidirection deflection circuit of FIG. 5(*c*), illustrating bidirectional movement of the electron beam spot across and maintenance of the spot at selected positions on the screen during operation of the bidirectional deflection amplifier circuit of FIG. 5.

DETAILED DESCRIPTION OF THE INVENTION

Prior Art System

Figure 1:
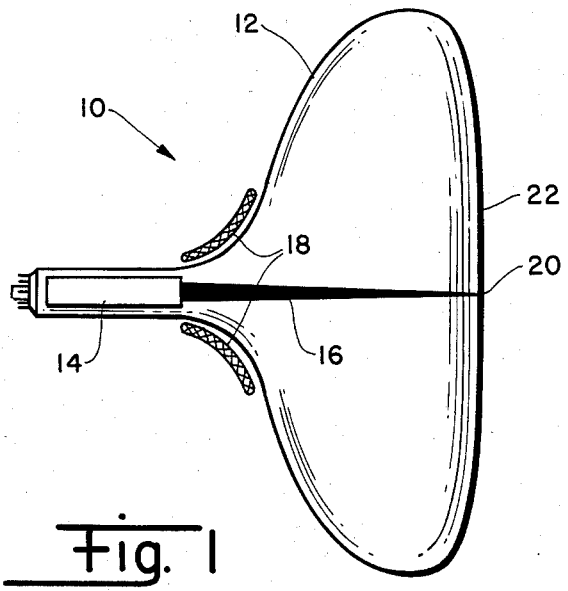
Fig. 1 PRIOR ART
FIG. 1 is a schematical representation of the picture tube and magnetic deflection yoke of a conventional display monitor with which the quasi-resonant random access deflection system of the present invention can be used.
Figure 2:
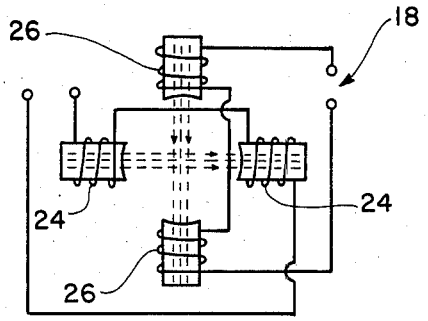
Fig. 2 PRIOR ART
FIG. 2 is a simplified representation of the magnetic deflection yoke of FIG. 1.

Referring now to the drawings, and particularly to FIGS. 1 and 2, there is illustrated in FIG. 1 a simplified representation of a conventional display monitor 10 having a video picture tube 12 with components 14 for generating and focussing an electron beam 16. The monitor 10 also has a deflection yoke 18 for magnetically deflecting the beam 16 horizontally and vertically so as to move a spot 20, produced on the display monitor screen 22 by the electron beam 16, across the screen. The arrangement of the windings 24,26 forming the deflection yoke 18 and the magnetic fields they generate are illustrated in a simplified form in FIG. 2.

Figure 3:
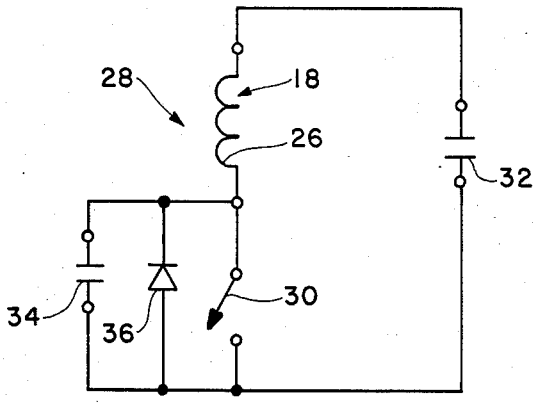
Fig. 3 PRIOR ART
FIG. 3 is a simplified representation of the basic prior art resonant deflection amplifier circuit which has been used heretofore with the deflection yoke of FIGS. 1 and 2.

Turning to FIG. 3, there is seen a basic prior art resonant deflection amplifier circuit, generally designated 28, of a conventional raster scan system being connected to the winding 26 of the deflection yoke 18 for causing horizontal deflection of the electron beam 16. At this point, a brief explanation of the operation of this circuit with reference to FIG. 4 will facilitate a greater understanding the quasi-resonant deflection system of the present invention when it is described at a later time. The operation of the resonant deflection circuit 28 will be described with respect to three distinct time intervals. Each time interval represents one successive segment of the horizontal scan line time period. The movement of the electron beam spot 20 on the screen 22 during each of these segments is depicted in FIG. 4.

Figure 4:
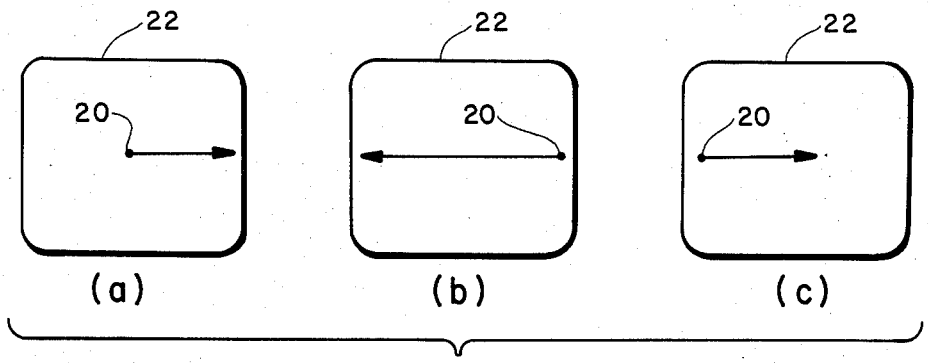
Fig. 4 PRIOR ART
FIG. 4 is a series of views of the screen of the display monitor picture tube of FIG. 1, illustrating in successive segments the movement of the electron beam spot horizontally across the screen during operation of the prior art amplifier circuit of FIG. 3.

Although movement of the electron beam spot 20 is actually continuous, that is to say, the spot is never stopped or parked, whenever the monitor 10 is turned on, it will be assumed that the spot 20 of the electron beam 16 is centered on the screen 22 of the display monitor 10, as seen in FIG. 4(*a*), when the first time interval begins.

The first time interval begins when a switch 30 in the circuit 28 is closed so as to complete the circuit through the deflection yoke 18 and a shaper capacitor 32 therein. Current flows through the deflection yoke 18 toward the switch 30 as the initially-charged capacitor 32 discharges causing the electron beam spot 20 to move from the center to the right side of the screen 22, as depicted in FIG. 4(*a*). The first time interval consumes about 45% of the total horizontal line period.

The second time interval commences when the switch 30 is opened. Now, the completed circuit 28 is comprised of the deflection yoke 18, the shaper capacitor 32 and a flyback or retrace capacitor 34 which begin to oscillate at their resonant frequency. In particular, during the first half cycle of oscillation, the stored emf of the deflection yoke 18 charges the flyback capacitor 34 causing the electron beam spot 20 to retrace from the right to the left side of the screen 22, as seen in FIG. 4(*b*). The second time interval takes up about 20% of the total horizontal line period.

The third and final time interval starts at the end of the first half cycle of oscillation when the flyback capacitor 34 is fully discharged and the polarity across a damper rectifier or diode 36 is such that it conducts and causes the oscillation to stop. The current conducted through the deflection yoke 18 from the diode 36 causes the electron beam spot 20 to move from the left side of the screen 22 back to the center thereof, as seen in FIG. 4(*c*). The third time interval, during which the damper diode 36 is in conduction, takes up the remaining 35% of the horizontal line period. The third time interval ends when the beam 16 reaches the center of the screen 22 and the damper diode 36 stops conducting.

As mentioned earlier, the resonant deflection amplifier circuit 28 is highly energy efficient. Except for small ohmic losses in the windings of the deflection yoke 18 and losses within the resonant switch 30, the amplifier circuit 28 merely controls the transfer of energy between the magnetic field of the deflection yoke 18 and the electric fields within the shaper and flyback capacitors 32,34. Power dissipation in the resonant amplifier circuit 28 is typically only a few watts and the current draw on the power supply (not shown) is usually only several hundred milliamperes even though the peak deflection yoke current can be 5 to 10 amperes. It will be readily seen that it is these features of the prior art raster scan resonant deflection system that are the most desirable ones to emulate in the quasi-resonant random access deflection system which will now be described.

Quasi-Resonant Random Access Deflection System

Figure 5:
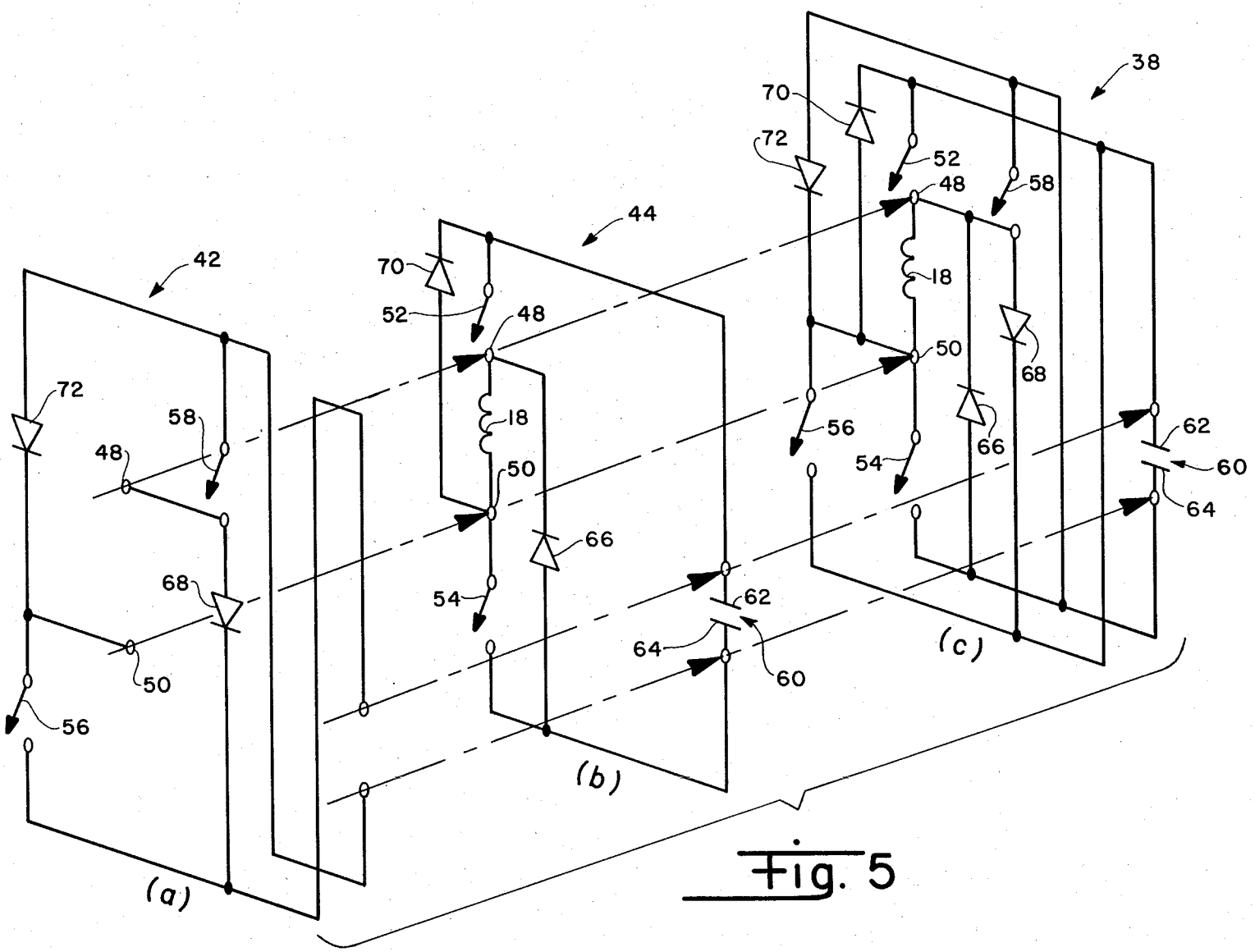
FIG. 5 is a schematical representation of the bidirectional deflection amplifier circuit in the quasi-resonant random access deflection system of the present invention, showing in FIGS. 5(*a*) and 5(*b*) circuit portions which are complementary to one another for achieving bidirectional deflection of the electron beam and in FIG. 5(*c*) the complementary circuit portions combined together.
Figure 7:
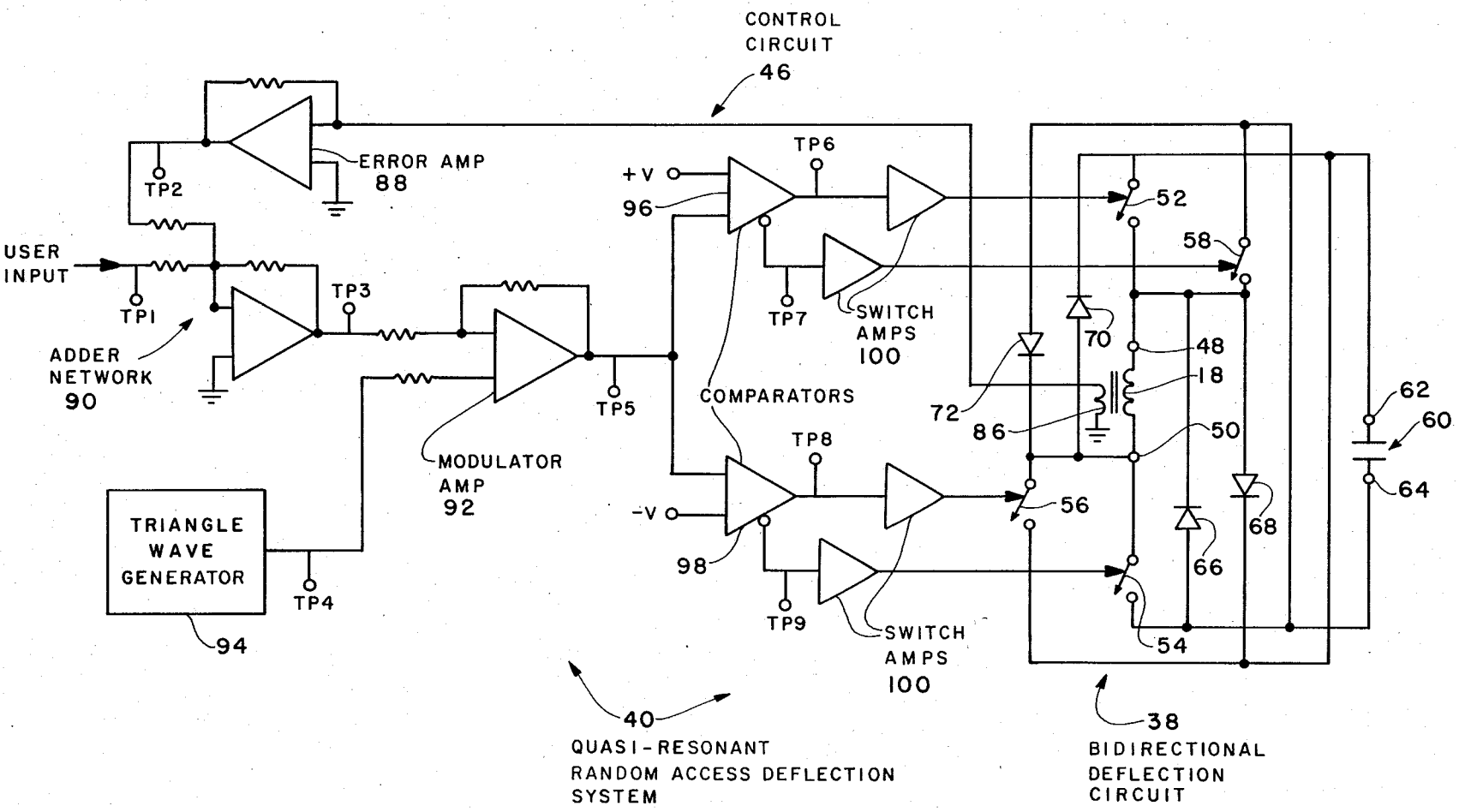
FIG. 7 is a schematical representation of the quasi-resonant random deflection system of the present invention connected with the horizontal deflection winding of the deflection yoke of FIGS. 1 and 2, illustrating the bidirectional deflection amplifier circuit of FIG. 5 interfaced with a circuit which generates the desired control signals to operate the bidirectional deflection amplifier.

Turning now to FIGS. 5 through 7, there is shown in both FIGS. 5 and 7 the bidirectional deflection amplifier circuit, generally designated 38, in the quasi-resonant random access deflection system of the present invention which is illustrated in FIG. 7 and identified by the numeral 40. FIGS. 5(*a*) and 5(*b*) depict complementary circuit portions 42,44 which when combined together form the bidirectional deflection amplifier circuit 38 seen in FIG. 5(*c*) and also in FIG. 7.

Figure 8:
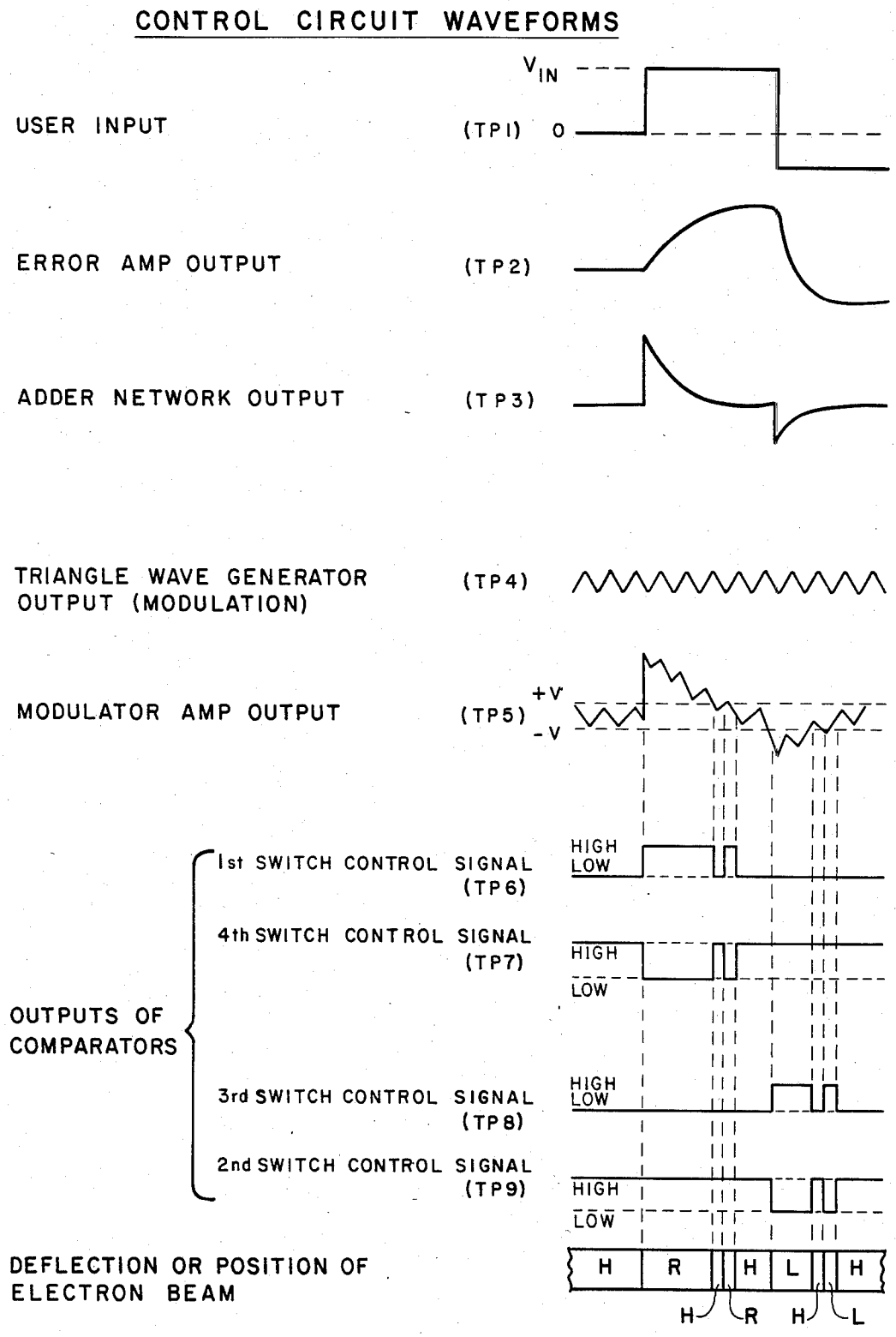
FIG. 8 is a diagram depicting the waveforms of signals produced by the control circuit of FIG. 7 at various test points in the circuit, the diagram being useful in explaining in detail the operation of the circuit.

Basically, in addition to the bidirectional deflection amplifier circuit 38, the quasi-resonant random access deflection system 40, as seen in FIG. 7, includes a control circuit 46 connected to the bidirectional deflection amplifier circuit. The bidirectional deflection amplifier circuit 38 is connected to opposite first and second terminals 48,50 of one of the windings of the deflection yoke 18, for example winding 26, and, as will be explained in detail below, is adapted to be actuated by the control circuit 46 so as to cause selected movement, such as in the horizontal direction, of the electron beam 16 along a bidirectional path and stopping of the beam at any position along the bidirectional path. FIG. 8 illustrates the waveforms of signals produced at various test points in the control circuit 46.

More specifically, with reference to FIGS. 5 to 7, the bidirectional deflection amplifier circuit 38 includes a plurality of first, second, third and fourth switches 52,54,56,58, a capacitor 60 having opposite first and second plates 62,64, and a plurality of first, second, third, and fourth diodes 66,68,70,72. The first and second switches 52,54 are connected respectively to the first and second terminals 48,50 of the deflection yoke 18 and to the first and second plates 62,64 of the capacitor 60, whereas the third and fourth switches are connected respectively to the second and first terminals 50,48 of the deflection yoke 18 and to the first and second plates 62,64 of the capacitor 60. The first diode 66 is connected at its cathode to the first terminal 48 of the deflection yoke 18 and at its anode to the second plate 64 of the capacitor 60. The second diode 68 is connected at its anode to the first terminal 48 of the deflection yoke 18 and at its cathode to the first plate 62 of the capacitor 60. The third diode 70 is connected at its anode to the second terminal 50 of the deflection yoke 18 and at its cathode to the first plate 62 of the capacitor 60. Finally, the fourth diode 72 is connected at its cathode to the second terminal 50 of the deflection yoke 18 and at its anode to the second plate 64 of the capacitor 60.

With reference to FIG. 6, it will be seen that the switches 52,54,56,58 of the bidirectional deflection circuit 38 are actuatable to predetermined combinations of states to cause selected movement and stopping of the electron beam 16 on the screen 22 of the display monitor picture tube 12. Each of the switches is actuatable between open and closed states and can take the form of a conventional transistor. The control circuit 46 is operable, as will be described later with reference to FIG. 8, to generate predetermined combinations of signals to actuate the switches to the predetermined combinations of states.

In FIG. 6(*a*), it is observed that the electron beam spot 20 is returned to the center of the screen 22 when all switches 52, 54,56,58 of the bidirectional deflection circuit 38 are actuated to open states. The two possible circuit paths 74,76 of current flow serve to charge the capacitor 60 and result in return of the electron beam to an undeflected state. When the capacitor 60 is fully charged, the diodes 66,68,70,72 become reverse biased such that the capacitor 60 remains in its fully charged condition.

In FIG. 6(*b*), when first and third switches 52,56 are actuated to open states and second and fourth switches 54,58 actuated to closed states, the electron beam 16 as represented by its spot 20 on the screen 22 will be held or maintained stationary in any selected position along the bidirectional path through which the beam can be moved by the circuit 38. It will be observed that the deflection yoke 18 is short-circuited along either of circuit paths 78,80, regardless of the direction of current flow through the deflection yoke 18.

Turning to FIG. 6(*c*), the capacitor 60 discharges through the deflection yoke 18 with current flowing in a first direction along circuit path 82 through the yoke when the first and second switches 52,54 are actuated to closed states and the third and fourth switches 56,58 are actuated to open states.

Finally, referring to FIG. 6(*d*), the capacitor 60 again discharges through the deflection yoke 18 but this time with current flowing in a second opposite direction along circuit path 84 through the yoke when the third and fourth switches 56,58 are actuated to closed states and the first and second switches 52, 54 are actuated to open states. Deflection of the electron beam spot 20 in FIG. 6(*c*) can be considered to be in a positive direction while in FIG. 6(*d*) in a negative direction.

From the above, it will be understood that for the bidirectional deflection circuit 38 to deflect the beam, the four switches 52,54,56,58 must be opened and closed in certain specific combinations. The actuation of the four switches to their respective states is subject to only two constraints: the third switch 56 must be open when the second switch 54 is closed and the fourth switch 58 must be open when the first switch 52 is closed. Failure to observe this rule will cause the storage capacitor 60 to discharge and collapse the deflections. Of the sixteen unique combinations of the four switches, all but the above four either violate the above constraints or provide no benefit to the user.

A close examination of the complementary circuit portions 42,44 of FIGS. 5(*a*) and 5(*b*) reveals that the bidirectional deflection amplifier circuit 38 shares the desirable features of the prior art resonant amplifier circuit 28 in terms of its energy efficiency brought about by its resonant characteristic. In each of the circuit portions 42,44 of the bidirectional deflection amplifier circuit, the deflection yoke 18 and the capacitor 60 are connected in a resonant relationship. Therefore, the bidirectional deflection circuit 38 exhibits a biresonant characteristic. Consequently, energy is transferred between capacitive storage and inductive storage elements with very little loss.

However, such examination also highlights the important ways in which the bidirectional deflection amplifier circuit 38 differs from the prior art resonant amplifier circuit 28. First, there is only one storage capacitor 60 in the bidirectional deflection circuit 38 of the present invention, not two as in the circuit 28 of the prior art raster scan system. Second, the energy stored in the capacitor 60 is gated to either side of the deflection yoke 18 by two pairs of switches—first and second switches 52,54 and third and fourth switches 56,58—in a way not found in the prior art circuit 28. Third, two pairs of diodes—first and second diodes 66,68 and third and fourth diodes 70,72—not present in the raster scan system, serve to route energy (charge) either back though the deflection yoke 18 or back into the energy storage capacitor 60. Thus, the circuitry necessary to achieve bidirectional deflection, which is lacking in the prior art circuit 28, is provided in circuit 38.

While the bidirectional deflection amplifier circuit 38 in the quasi-resonant random access deflection system 40 of the present invention solves a major shortcoming in high performance calligraphic display monitors, it also presents a challenge in regard to the switching of relatively high (10–20 amperes) currents in the short (tens of nanoseconds) times necessary to position the electron beam 16 to a single pixel width. The control circuit 46 shown in FIG. 7 interfaced with the bidirectional deflection circuit 38 substantially meets this challenge.

Turning finally to FIGS. 7 and 8, the control circuit 46 of the quasi-resonant random access deflection system 40 is interfaced, as seen in FIG. 7, with the switches 52,54,56,58 of the bidirectional deflection circuit 38 and produces switch control signals, which have the waveforms identified at test points TP6 to TP9 in FIG. 7 and depicted in FIG. 8, for actuating the switches. The control circuit 46 is also connected in closed loop relationship with the bidirectional deflection circuit 38 by a coil 86 being connected via an error amplifier 88 to an adder network 90 at the input side of the control circuit. The coil 86 is positioned in the magnetic field of the deflection yoke 18 for sensing current flowing in the yoke. The signal produced by the error amplifier 88, for example having the waveform identified at test point TP2, is summed with the user's input signal, such as one having the waveform identified at test point TP1, by the adder network 90. The output signal of the adder network, for instance having the waveform identified at test point TP3, is modulated at a modulator amplifier 92 by a triangle wave signal (see the waveform at test point TP4) outputted by a triangle wave generator 94. The output of the modulator applifier 92, having the waveform seen at test point TP5, is fed to first and second comparators 96,98, each of whose output is amplified by a switch amplifier 100 before actuating one of the switches 52,54,56,58.

Each of the first and second comparators 96,98 produces a pair of output signals, called switch control signals in FIG. 8, with one of the signals being the complement of the other, that is, when one is at a high level, the other is at a low level, and vice versa. Typical waveforms of these pairs of switch control signals are identified at test points TP 6 and TP7 and at test points TP8 and TP9, respectively, and illustrated in FIG. 8. Whenever the output of the modulator amplifier 92 exceeds a +V threshold level of the first comparator 96, the pair of switch control signals outputted by this comparator reverse their complementary levels. Similarly, whenever the output of the modulator amplifier 92 exceeds a −V threshold level of the second comparator 98, the pair of switch control signals outputted by this comparator also reverse their complementary levels. A high output level of a given one switch control signal from one of the comparators 96,98 actuates its respective one of the switches 52,54,56,58 to a closed state, whereas a low output level of the switch control signal actuates the switch to an open state. In view of the complementary relationship between the respective control signals for the first and fourth switches 52,58 and between the respective control signals for the second and third switches 54,56, it is readily understood that the constraints imposed on actuation of the four switches, as explained earlier, are always satisfied.

The relationship between the respective levels of the switch control signals outputted by the comparators 96,98 and the deflection and positioning of the electron beam 16 is illustrated in the lower half of FIG. 8. The latter relationship is in agreement with the relationship between the states of the four switches 52,54,56,58 and the electron beam deflection and position, which was described earlier and is depicted in FIGS. 6(*b*) to 6(*d*). In the bottom line of FIG. 8, the letter H refers to "hold" position, while letters R and L refer respectively to "right" and "left" deflections of the electron beam 16. The aforementioned relationship between the switch control signals and the electron beam will now be briefly explained with reference to FIG. 8 and also to FIGS. 6(*b*) to 6(*d*).

First, when the output of the modulator amplifier 92 is within the positive and negative threshold voltage limits (+V and −V) of the comparators 96,98, the second and fourth switch control signals are both at high levels, while the first and third switch control signals are both at low levels. This combination of control signals actuates the switches 52,54,56,58 to their second combination of states wherein the first and third switches 52,56 are open and the second and fourth switches 54,58 are closed, and the electron beam spot 20 is held or maintained in its deflected position, as seen in FIG. 6(*b*).

Next, when the output of the modulator amplifier 92 exceeds the positive threshold voltage limit (+V) of the first comparator 96, the first and fourth switch control signals reverse their levels. Now, the first and second switch control signals are both at high levels, while the third and fourth switch control signals are both at low levels. This combination of control signals actuates the switches to their third combination of states wherein the first and second switches 52,54 are closed and the third and fourth switches 56,58 are open, and the electron beam spot 20 is deflected toward the right, as seen in FIG. 6(*c*).

Lastly, when the output of the modulator amplifier 92 exceeds the negative threshold voltage limit (−V) of the second comparator 98, the second and third switch control signals reverse their levels. Now, the third and fourth switch control signals are both at high levels, while the first and second switch control signals are at low levels. This combination of control signals actuates the switches to their fourth combination of states wherein the first and second switches 52,54 are open and the third and fourth switches 56,58 are closed, and the electron beam spot 20 is deflected toward the left, as seen in FIG. 6(*d*).

All of the switches 52,54,56,58 assume open, or their first combination of, states when the control circuit 46 is deactivated, while the display monitor of the system 40 is still on. In this situation, the electron beam spot 20 is undeflected and returns to the center of the monitor screen 22, as seen in FIG. 6(*a*).

It is thought that the invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

I claim:

1. In a video display apparatus, such as a calligraphic display monitor, having means for generating an electron beam and a deflection yoke operable for magnetically deflecting said beam, said deflection yoke including first and second opposite terminals, a quasi-resonant random access deflection system comprising:

(a) a resonant deflection circuit connected to said deflection yoke and being actuable to cause selected movement of said beam along a bidirectional path and stopping of said beam at any position along said bidirectional path; and (b) a control circuit coupled to said resonant deflection circuit and being operable to actuate said resonant deflection circuit;

(c) said resonant deflection circuit including first, second, third and fourth switches and a capacitor having a pair of first and second opposite plates, said first and second switches being connected respectively to said first and second terminals of said deflection yoke and to said first and second plates of said capacitor, and said third and fourth switches being connected respectively to said second and first terminals of said deflection yoke and to said first and second plates of said capacitor.

2. The system as recited in claim 1, wherein:

said first, second, third and fourth switches of said resonant deflection circuit are actuable to predetermined combinations of states to cause said selected movement and stopping of said beam.

3. The system as recited in claim 2, wherein said resonant deflection circuit causes said beam to assure an undeflected position when said switches are actuated to a first combination of states.

4. The system as recited in claim 2, wherein said resonant deflection circuit causes holding of said beam at a substantially stationary position along said bidirectional path when said switches are actuated to a second combination of states.

5. The system as recited in claim 2, wherein said resonant deflection circuit causes deflection of said beam in a first direction along said bidirectional path when said switches are actuated to a third combination of states.

6. The system as recited in claim 2, wherein said resonant deflection circuit causes deflection of said beam in a second opposite direction along said bidirectional path when said switches are actuated to a fourth combination of states.

7. The system as recited in claim 1, wherein said resonant deflection circuit further includes first, second, third, and fourth diodes, each diode having an anode and a cathode, said first diode being connected at its cathode to said first terminal of said deflection yoke and at its anode to said second plate of said capacitor, said second diode being connected at its anode to said first terminal of said deflection yoke and at its cathode to said first plate of said capacitor, said third diode being connected at its anode to said second terminal of said deflection yoke and at its cathode to said first plate of said capacitor, and fourth diode being connected at its cathode to said second terminal of said deflection yoke and at its anode to said second plate of said capacitor.

8. The system as recited in claim 7, wherein said resonant deflection circuit causes said beam to assume an undeflected position when said switches are actuated to a first combination of states.

9. The system as recited in claim 8, wherein said first, second, third and fourth switches are all open when in said first combination of states.

10. The system as recited in claim 7, wherein said resonant deflection circuit causes holding of said beam at a substantially stationary position along said bidirectional path when said switches are actuated to a second combination of states.

11. The system as recited in claim 10, wherein said first and third switches are open and said second and fourth switches are closed when in said second combination of states.

12. The system as recited in claim 7, wherein said resonant deflection circuit causes deflection of said beam in a first direction along said bidirectional path when said switches are actuated to a third combination of states.

13. The system as recited in claim 12, wherein said first and second switches are closed and said third and fourth switches are open when in said third combination of states.

14. The system as recited in claim 7, wherein said resonant deflection circuit causes deflection of said beam in a second opposite direction along said bidirectional path when said switches are actuated to a fourth combination of states.

15. The system as recited in claim 14, wherein said first and second switches are open and said third and fourth switches are closed when in said fourth combination of states.

16. In a video display apparatus, such as a calligraphic display monitor, having means for generating an electron beam and a deflection yoke operable for magnetically deflecting said beam, a quasi-resonant random access deflection system comprising:

(a) a resonant deflection circuit connected to said deflection yoke and being actuatable to cause selected movement of said beam along a bidirectional path and stopping of said beam at any position along said bidirectional path, said resonant deflection circuit including a plurality of switches being actuatable to predetermined combinations of states to cause said selected movement and stopping of said beam; and (b) a control circuit coupled to said resonant deflection circuit and being operable to actuate said resonant deflection circuit by generating predetermined combinations of signals to actuate said switches of said resonant deflection circuit to said predetermined combinations of states, said control circuit including a pair of comparators which each receives a common input signal and produces a pair of switch control signals with one of said control signals being the complement of the other.

17. In a video display apparatus, such as a calligraphic display monitor, having means for generating an electron beam and a deflection yoke operable for magnetically deflecting said beam, a quasi-resonant random access deflection system comprising:

(a) a resonant deflection circuit connected to said deflection yoke and being actuatable to cause selected movement of said beam along a bidirectional path and stopping of said beam at any position along said bidirectional path, said resonant deflection circuit including a pluraltiy of switches being actuatable to predetermined combinations of states to cause said selected movement and stopping of said beam; and (b) a control circuit coupled to said resonant deflection circuit and being operable to actuate said resonant deflection circuit, said control circuit including means positioned in the magnetic field of said deflection yoke for generating a first signal representative of the current flowing in said yoke to establish a closed loop relationship between said control circuit and said resonant deflection circuit.

18. The system as recited in claim 17, wherein said control circuit includes means for receiving said first signal and a user's input signal and summing said signals to produce a combined input signal.

19. The system as recited in claim 18, wherein said control circuit includes means for receiving said combined input signal and a modulation signal and modulating said combined input signal to produce a modulated output signal.

20. The system as recited in claim 19, wherein said control circuit includes:

first means for receiving said modulated output signal and comparing the same with a predetermined positive threshold signal level to produce a first pair of complementary switch control signals; and second means for receiving said modulated output signal and comparing the same with a predetermined negative threshold signal level to produce a second pair of complementary switch control signals.

21. The system as recited in claim 20, wherein said first and second pairs of complementary switch control signals are produced in predetermined combinations of signals which actuate said switches to said predetermined combinations of states.

22. In a video display apparatus, such as a calligraphic display monitor, having means for generating an electron beam and a deflection yoke operable for magnetically deflecting said beam, a quasi-resonant random access deflection system comprising:

(a) a biresonant deflection circuit having first and second resonant circuit portions, each of said circuit portions being connected to said deflection yoke and sharing a common capacitor, said biresonant deflection circuit being actuatable to cause selected movement of said beam along a bidirectional path and stopping of said beam at any position along said bidirectional path; and (b) a control circuit coupled to said first and second resonant circuit portions of said biresonant deflection circuit and being operable to actuate said biresonant deflection circuit.

23. The system as recited in claim 22, wherein:

said first resonant circuit portion of said biresonant deflection circuit includes a first pair of switches; and said second resonant circuit portion of said biresonant deflection circuit includes a second pair of switches, said first and second pairs of switches being actuatable to predetermined combinations of states to cause said selected movement and stopping of said beam.

24. The system as recited in claim 23, wherein said control circuit is operable to produce first and second pairs of complementary switch control signals in predetermined combinations thereof to actuate said first and second pairs of switches to said predetermined combinations of states.

25. The system as recited in claim 22, wherein said control circuit is coupled to said deflection yoke for establishing a closed loop relationship between said control circuit and said biresonant deflection circuit.

26. In a video display apparatus, such as a calligraphic display monitor, having means for generating an electron beam, the combination comprising:

(a) a deflection yoke operable for magnetically deflecting said beam; and (b) a biresonant deflection circuit having first and second resonant circuit portions, each of said circuit portions being connected to said deflection yoke and sharing a common capacitor;

(c) said first resonant circuit portion of said bireso-nant deflection circuit including a first pair of switches;

(d) said second resonant circuit portion of said bireso-nant deflection circuit including a second pair of switches;

(e) said first and second pairs switches being actuat-able to predetermined combinations of states to cause selected movement of said beam along a bidirectional path and stopping of said beam at any position along said bidirectional path.

* * * * *